US005469710A

United States Patent [19]

Howard et al.

[11] Patent Number: 5,469,710

[45] Date of Patent: Nov. 28, 1995

[54] CRYOGENIC RECTIFICATION SYSTEM WITH ENHANCED ARGON RECOVERY

[75] Inventors: Henry E. Howard, Grand Island; Neil M. Prosser, East Amherst; Mark J. Roberts, North Tonawanda, all of N.Y.

[73] Assignee: Praxair Technology, Inc., Danbury, Conn.

[21] Appl. No.: 329,386

[22] Filed: Oct. 26, 1994

[51] Int. Cl.[6] ..... F25J 3/04

[52] U.S. Cl. ..... 62/22; 62/24; 62/38

[58] Field of Search ..... 62/22, 24, 38

[56] References Cited

U.S. PATENT DOCUMENTS

| | | | |
|---|---|---|---|
| 2,316,056 | 4/1943 | DeBaufre | 62/175.5 |
| 4,575,388 | 3/1986 | Okada | 62/22 |
| 4,790,866 | 12/1988 | Rathbone | 62/22 |
| 4,822,395 | 4/1989 | Cheung | 62/22 |
| 4,832,719 | 5/1989 | Erickson | 62/22 |
| 4,842,625 | 6/1989 | Allam et al. | 62/22 |
| 5,034,043 | 7/1991 | Rottmann | 62/22 |
| 5,077,978 | 1/1992 | Agrawal et al. | 62/22 |
| 5,100,447 | 3/1992 | Krishnamurthy et al. | 62/24 |
| 5,108,476 | 4/1992 | Dray et al. | 62/38 |
| 5,114,449 | 5/1992 | Agrawal et al. | 62/22 |
| 5,161,380 | 11/1992 | Cheung | 62/22 |
| 5,265,429 | 11/1993 | Dray | 62/24 |
| 5,305,611 | 4/1994 | Howard | 62/22 |

*Primary Examiner*—Ronald C. Capossela
*Attorney, Agent, or Firm*—Stanley Ktorides

[57] ABSTRACT

A cryogenic air separation system which improves argon recovery wherein vapor from the argon column top condenser is turboexpanded to generate refrigeration and is then passed into the lower pressure column.

8 Claims, 4 Drawing Sheets

CRYOGENIC RECTIFICATION SYSTEM WITH ENHANCED ARGON RECOVERY

TECHNICAL FIELD

This invention relates generally to the cryogenic rectification of feed air and more particularly to the cryogenic rectification of feed air wherein argon product is produced.

BACKGROUND ART

The cryogenic rectification of air to produce oxygen, nitrogen and/or argon is a well established industrial process. Typically the feed air is separated into nitrogen and oxygen in a double column system wherein nitrogen top vapor from a higher pressure column is used to reboil oxygen-rich bottom liquid in a lower pressure column. Argon-containing fluid from the lower pressure column is passed into an argon side arm column for the production of argon product.

Refrigeration for the system is typically produced by turboexpanding a portion of the feed air stream. The non-turboexpanded portion of the feed air is passed into the higher pressure column while the turboexpanded portion of the feed air is passed into the lower pressure column. The feed air is separated in the higher pressure column into nitrogen-richer and oxygen-richer components which are passed into the lower pressure column for final separation.

To increase production or performance of the plant, the refrigeration requirement may be increased, necessitating the turboexpansion of a larger fraction of the feed air. This increases the amount of feed air passed into lower pressure column. However, this reduces the separation efficiency of the lower pressure column and in particular tends to reduce the argon concentration in the argon-containing fluid passed from the lower pressure column into the argon column. This burdens the recovery of argon product from the argon column.

Accordingly, it is an object of this invention to provide an improved cryogenic rectification system which can provide enhanced argon recovery.

It is another object of this invention to provide an improved cryogenic rectification system wherein increased refrigeration may be produced without increasing the feed air fraction which is turboexpanded and passed into the lower pressure column.

SUMMARY OF THE INVENTION

The above and other objects, which will become apparent to one skilled in the art upon a reading of this disclosure, are attained by the present invention, one aspect of which is:

A method for the cryogenic rectification of feed air employing a higher pressure column, a lower pressure column, and an argon column, comprising:

(A) passing feed air into the higher pressure column and separating feed air within the higher pressure column by cryogenic rectification into nitrogen-enriched fluid and oxygen-enriched fluid;

(B) passing argon-containing fluid into the lower pressure column;

(C) passing argon-containing fluid from the lower pressure column into the argon column and separating argon-containing fluid by cryogenic rectification within the argon column into argon-richer vapor and oxygen-richer liquid;

(D) at least partially condensing argon-richer vapor by indirect heat exchange with vaporizing elevated pressure liquid having a pressure which exceeds that of the lower pressure column to produce elevated pressure vapor;

(E) turboexpanding elevated pressure vapor to generate refrigeration;

(F) passing resulting turboexpanded vapor into the lower pressure column; and (G) recovering argon-richer fluid as argon product.

Another aspect of the invention is:

A cryogenic rectification apparatus comprising:

(A) a first column, a second column, and an argon column having a top condenser;

(B) means for passing feed air into the first column and means for passing fluid into the second column;

(C) means for passing fluid from the second column into the argon column;

(D) means for passing vapor into the top condenser and means for passing elevated pressure liquid into the top condenser;

(E) a turboexpander and means for passing elevated pressure vapor from the top condenser to the turboexpander;

(F) means for passing turboexpanded vapor from the turboexpander into the second column; and (G) means for recovering fluid from the argon column as argon product.

As used herein, the term "feed air" means a mixture comprising primarily nitrogen, oxygen and argon, such as ambient air.

As used herein, the terms "turboexpansion" and "turboexpander"0 mean respectively method and apparatus for the flow of high pressure gas through a turbine to reduce the pressure and the temperature of the gas thereby generating refrigeration.

As used herein, the term "column" means a distillation or fractionation column or zone, i.e., a contacting column or zone wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook fifth edition, edited by R. H. Perry and C. H. Chilton, McGraw-Hill Book Company, N.Y., Section 13, *The Continuous Distillation Process*. The term, double column is preferably used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation. Other double column arrangements that utilize the combination of a higher pressure column and a lower pressure column can also be used in the practice of this invention.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is usually adiabatic and can include stagewise or continuous contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluid streams into heat exchange relation without any physical contact or intermixing of the fluids with each other.

As used herein, the term "argon column" means a column which processes a feed comprising argon and produces a product having an argon concentration which exceeds that of the feed.

As used herein the term "top condenser" means a heat exchange device which generates column downflow liquid from column top vapor.

As used herein, the terms "upper portion" and "lower portion" mean those sections of a column respectively above and below the midpoint of the column.

DETAILED DESCRIPTION

The invention is a cryogenic rectification system wherein liquid vaporized in the argon column top condenser is turboexpanded to generate refrigeration for use in the cryogenic rectification thus reducing the amount of feed air which must be turboexpanded in order to achieve the refrigeration requirements for the separation.

The invention will be described in detail with reference to the Drawings.

Figure 1:
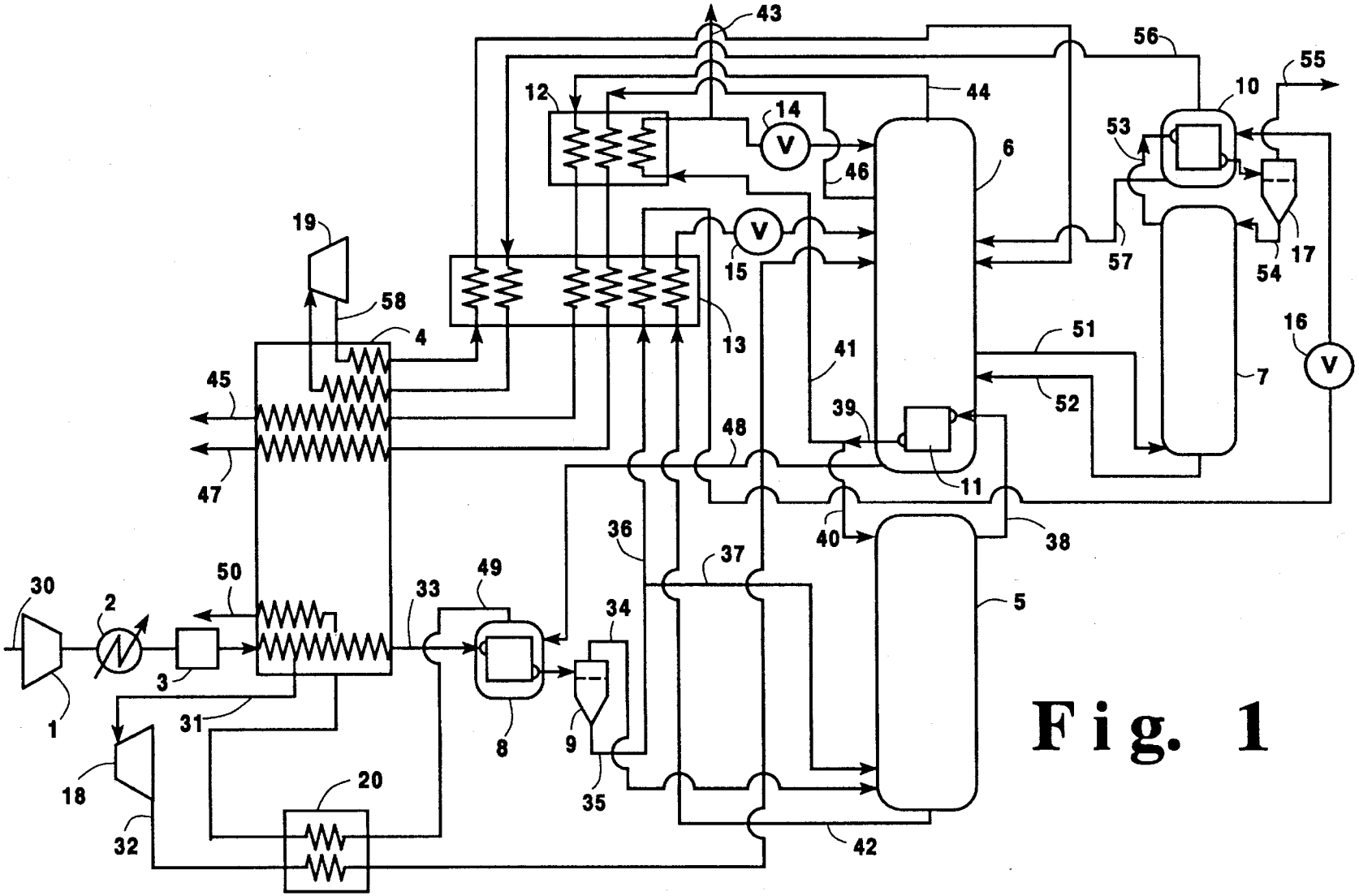
FIG. 1 is a schematic representation of one preferred embodiment of the invention wherein the elevated pressure liquid is taken from a product boiler.

Referring now to FIG. 1, feed air 30 is compresses to a pressure generally within the range of from 70 to 250 pounds per square inch (psia) in base load air compressor 1, cooled of the heat of compression in cooler 2, and cleaned of high boiling impurities such as water vapor and carbon dioxide in purifier 3. The feed air is then cooled by passage through main heat exchanger 4 by indirect heat exchange with return streams. A portion 31, generally comprising from 5 to 20 percent of the feed air, is withdrawn after partial traverse of main heat exchanger 4 and turboexpanded through turboexpander 18 to generate refrigeration. Turboexpanded feed air portion 32 is then cooled by passage through heat exchanger 20 and then passed into lower pressure column 6. The major portion of the feed air 33 is passed into product boiler 8 wherein it is at least partially condensed and then passed into phase separator 9. Vapor 34 from phase separator 9 is passed into higher pressure column 5. Liquid 35 is withdrawn from phase separator 9 and divided into portions 36 and 37. This liquid has a higher oxygen concentration and a lower nitrogen concentration than does the feed air stream 30. Portion 36 is passed to argon column top condenser 10 as will be more fully described later. Portion 37 is passed into higher pressure column 5.

First or higher pressure column 5 is the higher pressure column of a double column which also comprises second or lower pressure column 6. Higher pressure column 5 is operating at a pressure generally within the range of from 70 to 250 psia. Within higher pressure column 5 the feed air is separated by cryogenic rectification into nitrogen-enriched vapor and oxygen-enriched liquid. Nitrogen-enriched vapor is passed in stream 38 into main condenser 11 wherein it is condensed by indirect heat exchange with vaporizing lower pressure column 6 bottom liquid. Resulting nitrogen-enriched liquid 39 is then divided into stream 40, which is passed into higher pressure column 5 as reflux, and into stream 41 which is subcooled by passage through heat exchanger 12 and then passed through valve 14 into lower pressure column 6 as reflux. If desired, a portion 43 of the nitrogen-enriched liquid may be recovered as product liquid nitrogen. Oxygen-enriched liquid, generally having an oxygen concentration within the range of from 35 to 40 mole percent, and an argon concentration within the range of from 1 to 2 mole percent, is withdrawn from the lower portion of higher pressure column 5 as stream 42, subcooled by passage through heat exchanger 13 and then passed through valve 15 into lower pressure column 6.

Lower pressure column 6 is operating at a pressure less than that of higher pressure column 5 and generally within the range of from 15 to 85 psia. Within lower pressure column 6 the various feeds into this column are separated by cryogenic rectification into nitrogen-rich vapor and oxygen-rich fluid. Nitrogen-rich vapor is withdrawn from the upper portion of column 6 as stream 44, warmed by passage through heat exchangers 12, 13 and 4 and withdrawn from the system as stream 45 which may be recovered in whole or in part as product nitrogen having an oxygen concentration of less than 10 parts per million (ppm). For product purity control purposes a waste stream 46 is withdrawn from column 6 at a point below the stream 44 withdrawal point, is warmed by passage through heat exchangers 12, 13 and 4 and withdrawn from the system as stream 47. Oxygen-rich fluid may be withdrawn from the lower portion of column 6 as either liquid or vapor. In the embodiment of the invention illustrated in FIG. 1, the oxygen-rich fluid is withdrawn as liquid stream 48 and passed into product boiler 8. A portion of stream 48 may be recovered as product liquid oxygen. Within product boiler 8 the oxygen-rich liquid is vaporized against the aforedescribed condensing feed air and the resulting vapor is withdrawn as stream 49, warmed by passage through heat exchangers 20 and 4 and withdrawn from the system as stream 50 which may be recovered in whole or in part as oxygen product having an oxygen concentration generally within the range of from 99.50 to 99.99 mole percent.

Stream 51, generally having an argon concentration within the range of from 5 to 20 mole percent with the remainder being primarily oxygen, is passed from column 6 into the argon column which comprises argon column section 7 and top condenser 10. Within the argon column, feed stream 51 is separated by cryogenic rectification into argon-richer vapor and oxygen-richer liquid. The oxygen-richer liquid is passed from column into column 6 in stream 52. Argon-richer vapor is passed as stream 53 into top condenser 10 wherein it is at least partially condensed and then passed into phase separator 17. Liquid from phase separator 17 is passed in stream 54 into column section 7 as reflux. A portion of stream 54 may be recovered as product argon having an argon concentration of at least 80 mole percent and generally within the range of from 97 to 99 mole percent while vapor from phase separator 17 may be recovered as stream 55 having similar concentration characteristics as the liquid from the phase separator.

The argon-richer vapor in top condenser 10 is condensed by indirect heat exchange with vaporizing elevated pressure liquid which has a pressure exceeding that of the lower pressure column, generally by at least 5 pounds per square inch (psi) and preferably by from 5 to 10 psi. In the embodiment illustrated in FIG. 1 the elevated pressure liquid is liquefied stream 36 taken from the feed air input train which is subcooled by passage through heat exchanger 13 and then passed through valve 16 and into top condenser 10. The elevated pressure liquid within top condenser 10 is vaporized against the condensing argon-richer vapor and the resulting elevated pressure vapor is withdrawn from top condenser 10 as stream 56. Elevated pressure liquid which is not vaporized in top condenser 10 is passed through line 57 into lower pressure column 6. Elevated pressure vapor stream 56 is warmed by passage through heat exchanger 13 and 4 and then passed into turboexpander 19 wherein it is turboexpanded to generate refrigeration. The resulting turboexpanded vapor stream 58 is reintroduced into main heat exchanger 4 at a cooler location, cooled by passage through heat exchangers 4 and 13 and then passed into lower pressure column 6 at an intermediate location. The turboexpansion of the elevated pressure vapor through turboexpander 19 generates refrigeration which is put into the column system with stream 58 thus serving to reduce the fraction 31 of the feed air which must be turboexpanded for the requisite system refrigeration.

Figure 2:
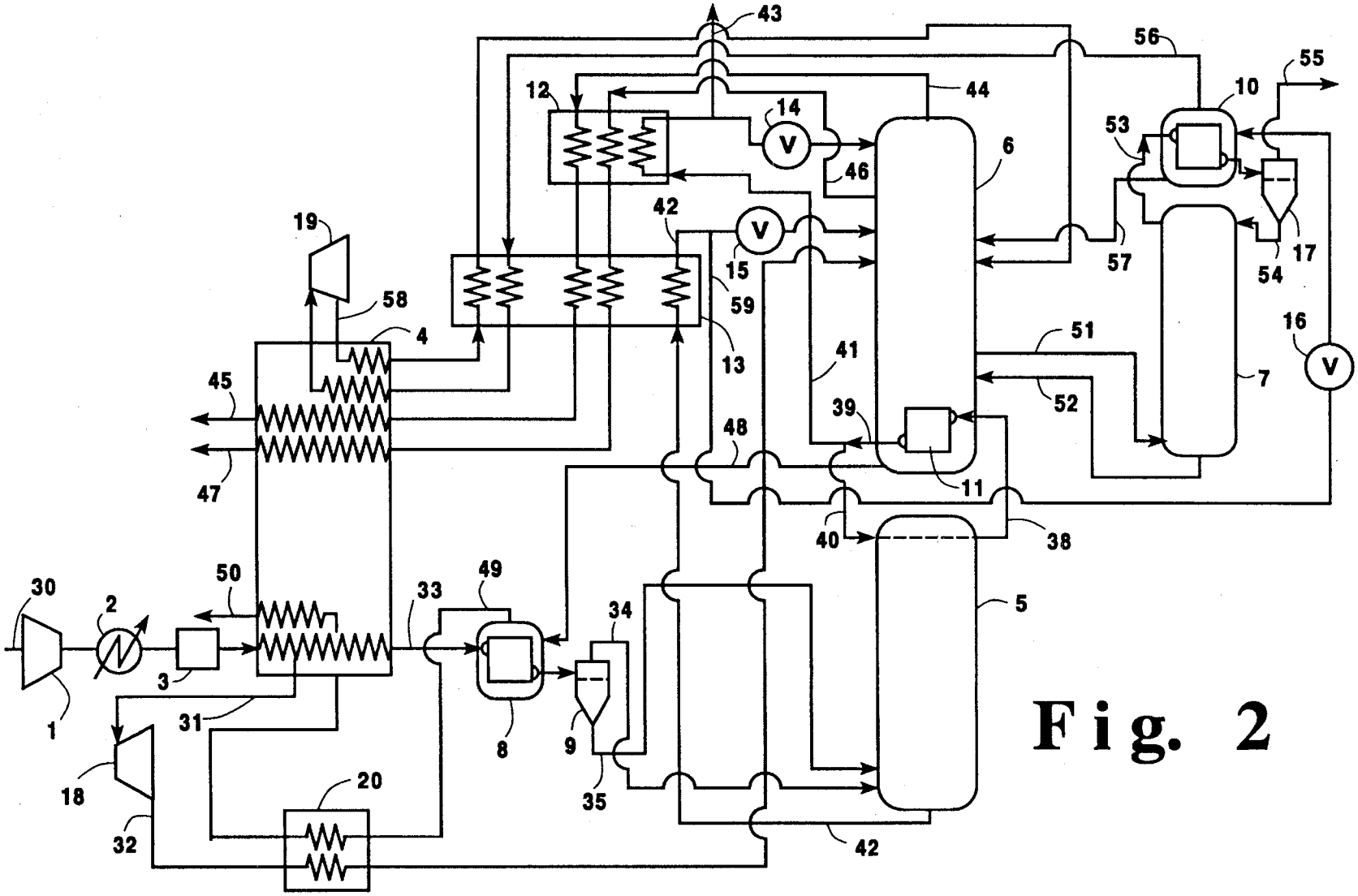
FIG. 2 is a schematic representation of another preferred embodiment of the invention wherein the elevated pressure liquid is oxygen-enriched liquid taken from the lower portion of the higher pressure column.
Figure 3:
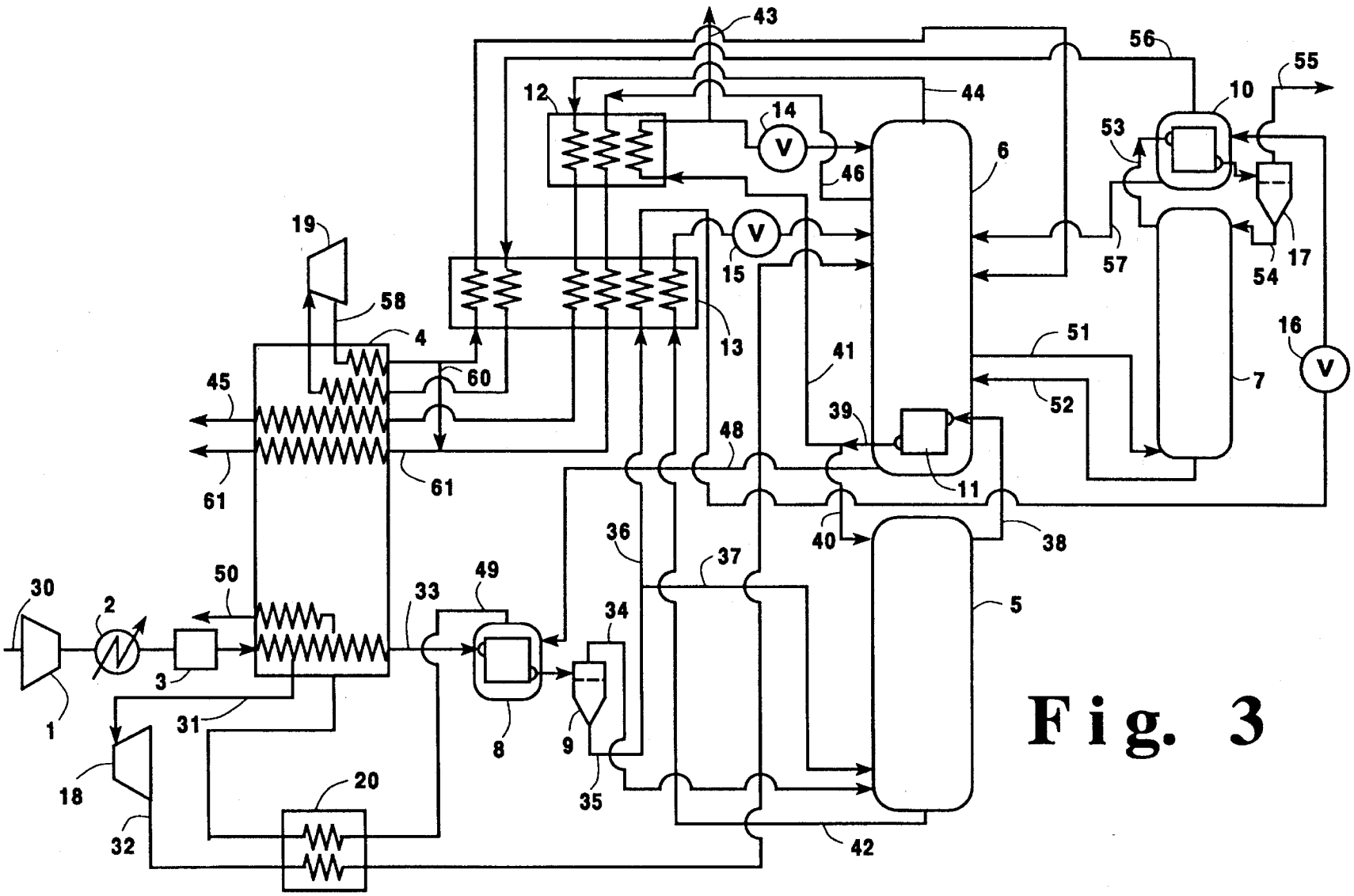
FIG. 3 is a schematic representation of another preferred embodiment of the invention wherein a portion of the turboexpanded vapor is combined with waste nitrogen.
Figure 4:
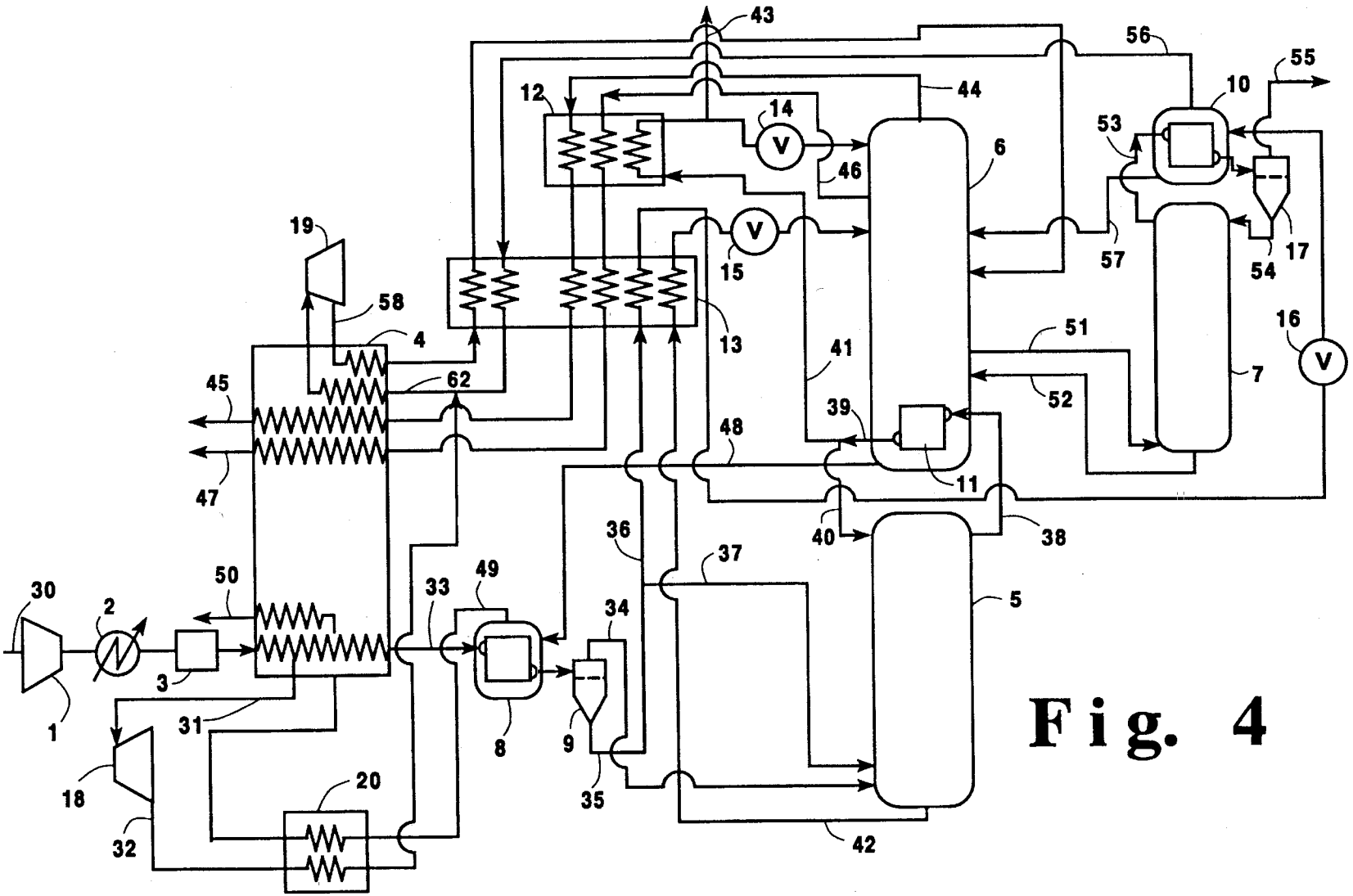
FIG. 4 is a schematic representation of another preferred embodiment of the invention wherein partially turboexpanded feed air is added to the elevated pressure vapor prior to final turboexpansion.

FIGS. 2, 3 and 4 illustrate other preferred embodiments of the invention. The numerals in FIGS. 2, 3 and 4 correspond to those of FIG. 1 for the common elements and these common elements will not be described again in detail.

In the embodiment illustrated in FIG. 2 the elevated pressure liquid which is passed into top condenser 10 is not taken from phase separator 9, but, rather, is oxygen-enriched liquid taken from the lower portion of higher pressure column 5. Oxygen-enriched liquid stream 42 is withdrawn from column 5 and subcooled through heat exchanger 13. Thereafter a portion 59 is passed through valve 16 and into top condenser 10 wherein it is vaporized against condensing argon-richer vapor to generate the elevated pressure vapor for turboexpansion through turboexpander 19.

The embodiment illustrated in FIG. 3 is similar to that of FIG. 1. Referring now to FIG. 3, a portion 60 of turboexpanded stream 58 is not passed into lower pressure column 6 but, rather, is combined with waste stream 46 to form combined stream 61 which is then passed through main heat exchanger 4. In this way a portion of the refrigeration generated by the turboexpansion of the elevated pressure vapor through turboexpander 19 is passed by indirect heat exchange into the incoming feed air as it is cooled by passage through main heat exchanger 4. Alternatively, the turboexpanded portion 60 may be passed through a separate heat exchanger pass to cool the feed air. The turboexpanded portion emerges from heat exchanger 4 at ambient temperature.

The embodiment illustrated in FIG. 4 is similar to that of FIG. 1. Referring now to FIG. 4, turboexpanded feed air portion 32, after traversal of heat exchanger 20, is not passed directly into lower pressure column 6, but, rather, is combined with elevated pressure vapor stream 56 upstream of main heat exchanger 4. The resulting combined stream is then turboexpanded through turboexpander 19 and then passed into lower pressure column 6. This arrangement serves to increase the gas flowrate in turboexpander 19 thereby increasing the machine efficiency.

A computer simulation of the embodiment of the invention illustrated in FIG. 1 was carried out along with a computer simulation of a comparable conventional cycle which does not employ the invention, and the results of these simulations are presented for illustrative and comparative purposes. In the example the pressure at the top of the lower pressure column was about 18 psia. When all of the refrigeration for the system was generated by turboexpansion of a feed air fraction which is then passed into the lower pressure column, the system produced oxygen and argon products at recoveries of 95 and 62.5 percent respectively. When the invention was employed wherein some of the requisite refrigeration was produced by the turboexpansion of elevated pressure vapor taken from the argon column top condenser, wherein the turboexpander operated with a pressure ratio of 1.2, the recoveries of oxygen and argon product were 98.5 and 71.1 percent respectively, thus demonstrating the enhanced argon recovery attainable with the invention over that attained with a conventional system.

Although the invention has been described in detail with reference to certain preferred embodiments, those skilled in the art will recognize that there are other embodiments of the invention within the spirit and the scope of the claims.

What is claimed is:

1. A method for the cryogenic rectification of feed air employing a higher pressure column, a lower pressure column, and an argon column, comprising:

(A) passing feed air into the higher pressure column and separating feed air within the higher pressure column by cryogenic rectification into nitrogen-enriched fluid and oxygen-enriched fluid;

(B) passing argon-containing fluid into the lower pressure column;

(C) passing argon-containing fluid from the lower pressure column into the argon column and separating argon-containing fluid by cryogenic rectification within the argon column into argon-richer vapor and oxygen-richer liquid;

(D) at least partially condensing argon-richer vapor by indirect heat exchange with vaporizing elevated pressure liquid having a pressure which exceeds that of the lower pressure column to produce elevated pressure vapor;

(E) turboexpanding elevated pressure vapor to generate refrigeration;

(F) passing resulting turboexpanded vapor into the lower pressure column; and (G) recovering argon-richer fluid as argon product.

2. The method of claim 1 further comprising partially condensing the feed air and employing at least some of the resulting condensed feed air as the elevated pressure liquid.

3. The method of claim 1 wherein the elevated pressure liquid is oxygen-enriched fluid taken from the higher pressure column.

4. The method of claim 1 further comprising passing a portion of the turboexpanded vapor in indirect heat exchange with feed air to cool the feed air.

5. A cryogenic rectification apparatus comprising:

(A) a first column, a second column, and an argon column having a top condenser;

(B) means for passing feed air into the first column and means for passing fluid into the second column;

(C) means for passing fluid from the second column into the argon column;

(D) means for passing vapor into the top condenser and means for passing elevated pressure liquid into the top condenser;

(E) a turboexpander and means for passing elevated pressure vapor from the top condenser to the turboexpander;

(F) means for passing turboexpanded vapor from the turboexpander into the second column; and (G) means for recovering fluid from the argon column as argon product.

6. The apparatus of claim 5 further comprising a product boiler wherein the means for passing elevated pressure liquid into the top condenser communicates with the product boiler.

7. The apparatus of claim 5 wherein the means for passing elevated pressure liquid into the top condenser communicates with the lower portion of the first column.

8. The apparatus of claim 5 further comprising a main heat exchanger, means for passing feed air from the main heat exchanger into the first column, and means for passing turboexpanded vapor from the turboexpander to the main heat exchanger.

* * * * *